US008506423B2

(12) United States Patent
Oldknow et al.

(10) Patent No.: US 8,506,423 B2
(45) Date of Patent: Aug. 13, 2013

(54) GOLF CLUB WITH A REINFORCING STRUCTURE

(75) Inventors: Andrew G. V. Oldknow, Beaverton, OR (US); John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 447 days.

(21) Appl. No.: 12/624,135

(22) Filed: Nov. 23, 2009

(65) Prior Publication Data

US 2011/0124432 A1 May 26, 2011

(51) Int. Cl.
*A63B 53/04* (2006.01)

(52) U.S. Cl.
USPC ..... 473/346; 473/350

(58) Field of Classification Search
USPC ..... 473/324–350
See application file for complete search history.

(56) References Cited

U.S. PATENT DOCUMENTS

| | | | | | |
|---|---|---|---|---|---|
| 2,087,685 | A | * | 7/1937 | Hackney | 473/349 |
| 3,814,437 | A | * | 6/1974 | Winquist | 473/350 |
| 4,147,349 | A | * | 4/1979 | Jeghers | 473/291 |
| 4,826,172 | A | * | 5/1989 | Antonious | 473/350 |
| 4,928,972 | A | | 5/1990 | Nakanishi et al. | |
| 4,938,470 | A | * | 7/1990 | Antonious | 473/242 |
| 5,014,993 | A | * | 5/1991 | Antonious | 473/350 |
| D318,703 | S | * | 7/1991 | Shearer | D21/748 |
| 5,048,835 | A | * | 9/1991 | Gorman | 473/350 |
| D323,690 | S | * | 2/1992 | Hlinka | D21/748 |
| D327,720 | S | * | 7/1992 | Antonious | D21/748 |
| D332,478 | S | * | 1/1993 | Antonious | D21/749 |
| 5,295,689 | A | | 3/1994 | Lundberg | |
| 5,328,184 | A | * | 7/1994 | Antonious | 473/292 |
| 5,395,113 | A | * | 3/1995 | Antonious | 473/324 |
| D359,539 | S | * | 6/1995 | Allen | D21/749 |
| 5,447,307 | A | * | 9/1995 | Antonious | 473/350 |
| 5,547,194 | A | * | 8/1996 | Aizawa et al. | 473/350 |
| D379,393 | S | * | 5/1997 | Kubica et al. | D21/748 |
| D379,485 | S | * | 5/1997 | Ragano | D21/749 |
| 5,649,872 | A | * | 7/1997 | Antonious | 473/332 |
| D386,550 | S | * | 11/1997 | Wright et al. | D21/759 |
| D386,551 | S | * | 11/1997 | Solheim et al. | D21/759 |
| D392,356 | S | * | 3/1998 | Burrows | D21/748 |
| D401,652 | S | * | 11/1998 | Burrows | D21/748 |

(Continued)

FOREIGN PATENT DOCUMENTS

| | | | |
|---|---|---|---|
| EP | 1693087 | A1 * | 8/2006 |
| GB | 2310379 | | 8/1997 |

(Continued)

OTHER PUBLICATIONS

International Search Report corresponding to PCT Application No. PCT/US2010/051744, mailed Mar. 16, 2011.

*Primary Examiner* — Alvin Hunter
(74) *Attorney, Agent, or Firm* — Banner & Witcoff, Ltd.

(57) ABSTRACT

A cavity back golf club and golf club head having a reinforcing member is disclosed. The reinforcing member includes a connecting member, a first truss member, and a second truss member. The reinforcing member is engaged with a rear surface of a striking face of the golf club head and is at least partially located in a rear cavity of the golf club head. The reinforcing member provides structural integrity to a thin striking face on the golf club head. Additionally, a discretionary weight is engaged with a perimeter weight member at the toe portion of the golf club head.

22 Claims, 11 Drawing Sheets

(56) References Cited

U.S. PATENT DOCUMENTS

| | | | | | |
|---|---|---|---|---|---|
| D411,272 | S | * | 6/1999 | Burrows | D21/748 |
| D415,543 | S | * | 10/1999 | Knox | D21/748 |
| 5,967,903 | A | | 10/1999 | Cheng | |
| 6,045,456 | A | | 4/2000 | Best et al. | |
| 6,077,171 | A | * | 6/2000 | Yoneyama | 473/291 |
| RE36,950 | E | | 11/2000 | Allen | |
| 6,309,311 | B1 | * | 10/2001 | Lu | 473/332 |
| 6,379,262 | B1 | | 4/2002 | Boone | |
| 6,454,665 | B2 | * | 9/2002 | Antonious | 473/346 |
| 6,743,112 | B2 | * | 6/2004 | Nelson | 473/251 |
| 6,746,343 | B2 | * | 6/2004 | Yoneyama | 473/342 |
| 6,773,361 | B1 | * | 8/2004 | Lee | 473/335 |
| D501,237 | S | * | 1/2005 | Madore | D21/759 |
| 6,857,973 | B2 | * | 2/2005 | Wieland et al. | 473/342 |
| 6,887,164 | B2 | * | 5/2005 | Dewanjee et al. | 473/342 |
| 7,014,571 | B2 | | 3/2006 | Deshmukh | |
| 7,022,031 | B2 | | 4/2006 | Nishio | |
| 7,121,956 | B2 | * | 10/2006 | Lo | 473/335 |
| D539,863 | S | * | 4/2007 | Nunez et al. | D21/748 |
| D554,217 | S | * | 10/2007 | Ruggiero et al. | D21/759 |
| D554,218 | S | * | 10/2007 | Ruggiero et al. | D21/759 |
| 7,351,164 | B2 | | 4/2008 | Schweigert et al. | |
| 7,371,190 | B2 | | 5/2008 | Gilbert et al. | |
| 7,387,579 | B2 | | 6/2008 | Lin et al. | |
| 7,393,287 | B2 | | 7/2008 | Huang | |
| 7,399,238 | B2 | | 7/2008 | Hocknell et al. | |
| 7,775,906 | B2 | * | 8/2010 | Kusumoto | 473/342 |
| D635,627 | S | * | 4/2011 | Nicolette | D21/759 |
| 7,935,000 | B2 | * | 5/2011 | Stites | 473/291 |
| D647,582 | S | * | 10/2011 | Nicolette et al. | D21/748 |
| 8,202,174 | B2 | * | 6/2012 | Breier et al. | 473/332 |
| 8,226,498 | B2 | * | 7/2012 | Stites et al. | 473/329 |
| 2001/0001774 | A1 | | 5/2001 | Antonious | |
| 2004/0082404 | A1 | | 4/2004 | Willett et al. | |
| 2008/0096687 | A1 | | 4/2008 | Chen | |
| 2008/0293511 | A1 | | 11/2008 | Gilbert | |

FOREIGN PATENT DOCUMENTS

| | | | | |
|---|---|---|---|---|
| GB | 2430383 | | | 3/2007 |
| JP | 09066125 | A | * | 3/1997 |
| JP | 09066126 | A | * | 3/1997 |
| JP | 09154985 | A | * | 6/1997 |
| JP | 09225075 | A | * | 9/1997 |
| JP | 10248970 | A | * | 9/1998 |
| JP | 10277182 | A | * | 10/1998 |
| JP | 2000102632 | A | * | 4/2000 |
| JP | 2000126337 | A | * | 5/2000 |
| JP | 2000229138 | A | * | 8/2000 |
| JP | 2000245879 | A | * | 9/2000 |
| JP | 2001087430 | A | * | 4/2001 |
| JP | 2002065909 | A | * | 3/2002 |
| JP | 2002320692 | A | * | 11/2002 |
| JP | 2003159354 | A | * | 6/2003 |
| JP | 2003220161 | A | * | 8/2003 |
| JP | 2003339921 | A | * | 12/2003 |
| JP | 2006141806 | A | * | 6/2006 |
| JP | 2007089831 | A | * | 4/2007 |
| JP | 2007330579 | A | * | 12/2007 |
| JP | 2008132276 | A | * | 6/2008 |
| JP | 2009240587 | A | * | 10/2009 |

* cited by examiner

GOLF CLUB WITH A REINFORCING STRUCTURE

FIELD OF THE INVENTION

The invention relates generally to golf clubs, and specifically iron type golf clubs. More particularly, the invention concerns cavity back golf clubs and golf club heads.

BACKGROUND

Various golf club heads have been designed to improve a golfer's accuracy by assisting a golfer to square the club head face at impact with a golf ball. A number of these golf club heads reposition the weight of the golf club head in order to alter the location of the center of gravity. The location of the center of gravity of the golf club head is one factor that determines whether a golf ball is propelled in the intended direction and/or with the intended trajectory. When the center of gravity is positioned behind the point of engagement on the contact surface, the golf ball follows a generally straight route. When the center of gravity is spaced to a side of the point of engagement, however, the golf ball may follow a route that curves left or right, which is often referred to as a hook or a slice. Similarly, when the center of gravity is spaced above or below the point of engagement, the route of the golf ball may exhibit a boring or climbing trajectory.

Golf club heads, such as cavity back iron club heads, assist the golfer by locating the weight of the golf club head around the golf club head perimeter. Generally, the perimeter weighting increases the club head's moment of inertia about a vertical axis (Izz), which increases the club head's resistance to twisting about the vertical axis. Therefore, these perimeter weighted golf club heads are more forgiving than non-cavity back golf club heads thereby allowing a golf ball to be struck somewhat off center or miss-hit, while still providing relatively good distance and accuracy. Perimeter weighting, however, tends to provide a relatively high center of gravity of the club head, which can provide somewhat limited control of the trajectory of a ball hit by this golf club head. Therefore, there is a need in the art for a golf club head that repositions additional weight away from the golf club head face and/or lower in the golf club head structure to allow further options in positioning the center of gravity of a golf club head and/or to provide additional options in ball flight trajectory when using such club heads.

SUMMARY

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to golf club heads for iron type golf clubs (including 1 through 9 irons, iron type hybrid clubs, driving irons, and wedges (e.g., pitching wedges, lob wedges, gap wedges, sand wedges, etc.)) that include: a striking face that provides a front surface for engaging a golf ball and a rear surface opposite the front surface, a perimeter weighting member that extends rearward from the striking face and around at least a majority of a circumference of the striking face, and a reinforcing structure that is at least partially located in a rear cavity defined at least in part by the perimeter weighting member. The reinforcing structure may be engaged with the rear surface of the striking face. The reinforcing structure may include a first truss member, a second truss member, and a connecting member. The first and second truss members may extend from an upper portion of the perimeter weighting member to the connecting member. The first and second truss members may have at least one opening defined therein. The first and second truss members may be made of a material selected from the group consisting of: aluminum, magnesium, beryllium, aluminum alloys, magnesium alloys, beryllium alloys, thermoplastic polymers, thermosetting polymers, carbon-fiber reinforced composite materials, and glass-fiber reinforced materials. The connecting member may be located closer to a sole edge of the striking face than to a top edge of the striking face. Additionally, at least 50% of an overall surface of the striking face may have a thickness from the front surface to the rear surface of no greater than 0.1 inches. Additionally, a discretionary weight may be engaged with the perimeter weighting member. The discretionary weight may be at least 4 grams or within a range of 5 grams to 30 grams. The discretionary weight member may be made of a material selected from the group consisting of lead, tungsten, lead alloys, tungsten alloys, other metal materials that include lead, other metal materials that include tungsten, polymeric materials that include lead, and polymeric materials that include tungsten. Additionally, when the golf club head is soled and in a ball address orientation on a horizontal surface, the golf club head center of mass may be less than 0.6 inches above the horizontal surface.

Additional aspects of this invention relate to golf club heads for iron type golf clubs (including 1 through 9 irons, iron type hybrid clubs, driving irons, and wedges (e.g., pitching wedges, lob wedges, gap wedges, sand wedges, etc.)) that include: a striking face that provides a front surface for engaging a golf ball and a rear surface opposite the front surface, a perimeter weighting member that extends rearward from the striking face and around at least a majority of a circumference of the striking face, and a reinforcing structure that is at least partially located in a rear cavity defined at least in part by the perimeter weighting member. The reinforcing structure may be engaged with the rear surface of the striking face. The reinforcing member may further include a first truss member, a second truss member, and a connecting member. The first truss member may include a first pair of beams that extend from the connecting member to the upper portion of the perimeter weighting member. The first beams may be connected by at least one cross-beam which may create at least two openings. The second truss member may include a second pair of beams that extend from the connecting member to the upper portion of the perimeter weighting member. The second pair of beams may be connected by at least one cross-beam which may create at least two openings. The first pair of beams may be parallel or non-parallel, while the second pair of beams may be parallel or non-parallel. Additionally, the first and second pair of beams may meet at the connecting member or not meet at the connecting member. Additionally, the first and second pair of beams may meet at the upper portion of the perimeter weighting member or not meet at the upper portion of the perimeter weighting member. The first and second truss members may be made of a material selected from the group consisting of: aluminum, magnesium, beryllium, aluminum alloys, magnesium alloys, beryllium alloys, thermoplastic polymers, thermosetting polymers, carbon-fiber reinforced composite materials, and glass-fiber reinforced materials. The connecting member may be located closer to a sole edge of the striking face than to a top edge of the striking face. Additionally, at least 50% of an overall surface of the striking face may have a thickness from the front surface to the rear surface of no greater than 0.1 inches. Additionally, a discretionary weight may be engaged with the perimeter weighting member at the toe portion. The discretionary weight may be at least 4 grams or be within a range of 5 grams to 30 grams. The discretionary weight member may be made of a material selected from the group consisting of lead, tungsten, lead alloys, tungsten alloys, other metal materials that include lead, other metal materials that include tungsten, polymeric materials that include lead, and polymeric materials that include tungsten. Additionally, when the golf club head is soled and in a ball address orientation on a horizontal surface, the golf club head center of mass may be less than 0.6 inches above the horizontal surface.

Additional aspects relate to golf club structures that include golf club heads, e.g., of the types described above. Such golf club structures further may include one or more of: a shaft attached to the club head (via a hosel), and a grip attached to the shaft.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

A. GENERAL DESCRIPTION OF BASIC FEATURES OF IRON TYPE GOLF CLUBS ACCORDING TO EXAMPLES OF THIS INVENTION

Figure 1:
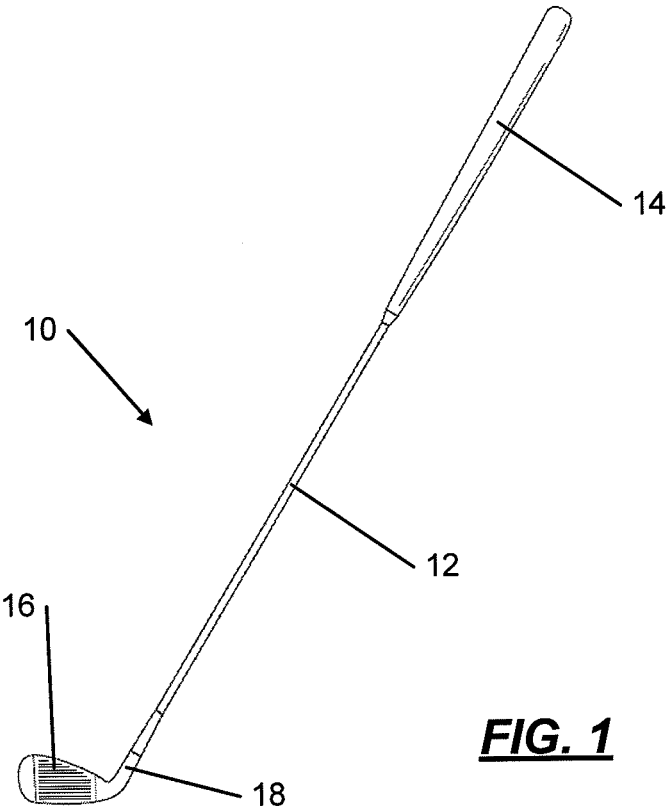
FIG. 1 illustrates an elevational view of a golf club having a golf club head in accordance with the present invention.

FIG. 1 illustrates an example of an iron-type golf club 10 in accordance with the present disclosure. The golf club 10 includes a shaft 12, a grip 14, and a golf club head 16. The club head 16 of FIG. 1 may be representative of a five iron golf club head of the present invention. The shaft 12 of the golf club 10 may be made of various materials such as steel, titanium, graphite, polymers, or composite materials, including conventional materials as are known and used in the art. The grip 14 is positioned on the shaft 12 to provide a golfer with a slip resistant surface in which to grasp the golf club 10. The grip 14 may be attached to, engaged with, and/or extend from the shaft 12 in any suitable or desired manner, including conventional manners known and used in the art, e.g., using adhesives or cements; via welding soldering, brazing, or the like; via mechanical connectors (such as threads, retaining elements, etc., including through releasable connection structures. A hosel 18 may be connected or part of the golf club head 16 for connecting the shaft 12 of FIG. 1 to the golf club head 16.

The shaft 12 may be received in, engaged with, and/or attached to the club head body 16 in any suitable or desired manner, including conventional manners known and used in the art, without departing from this disclosure. As more specific examples, the shaft 12 may be engaged with the club head 16 via adhesives, cements, welding, soldering, mechanical connectors (such as threads, retaining elements, or the like), etc. If desired, the shaft 12 may be connected to the club head 16 in a releasable manner using mechanical connectors to allow easy interchange of one shaft 12 for another on the club head 16.

B. DETAILED DESCRIPTION OF ASPECTS OF THIS INVENTION

The various figures in this application illustrate examples of ball striking devices according to this invention. When the same reference number appears in more than one drawing, that reference number is used consistently in this specification and the drawings to refer to the same or similar parts throughout.

1. Iron-Type Golf Club Heads According to Examples of this Invention

Figure 2:
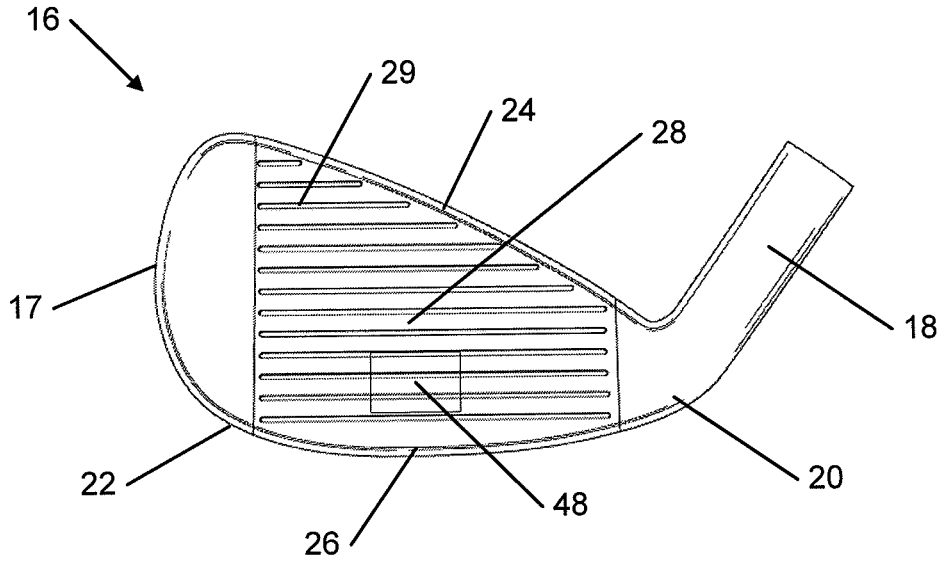
FIG. 2 illustrates a front view of a golf club head in accordance with the present invention.
Figure 3:
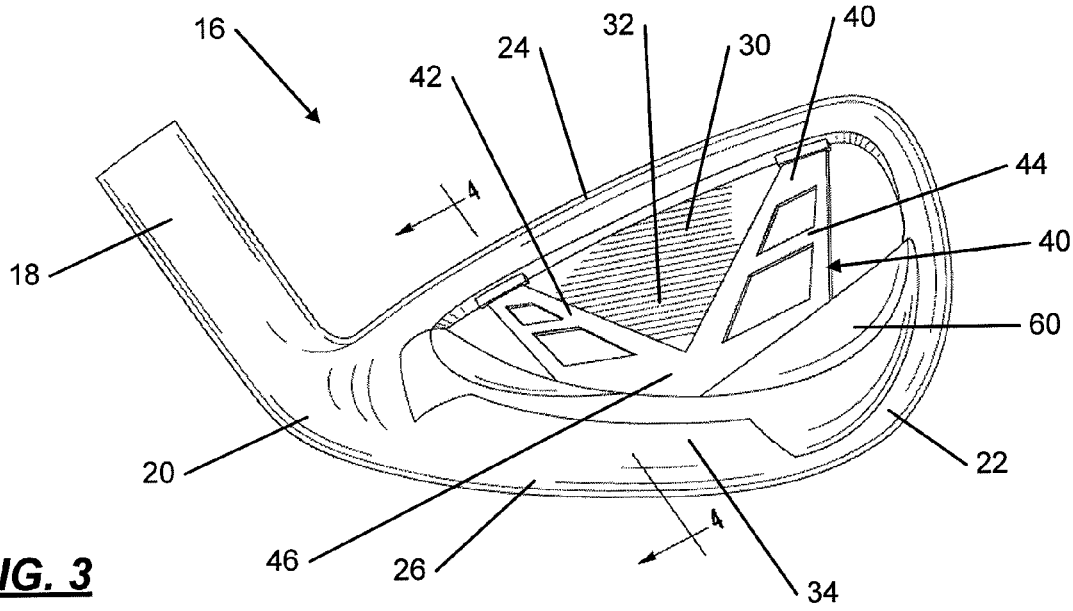
FIG. 3 illustrates a rear view of an example golf club head in accordance with the present invention.
Figure 4:
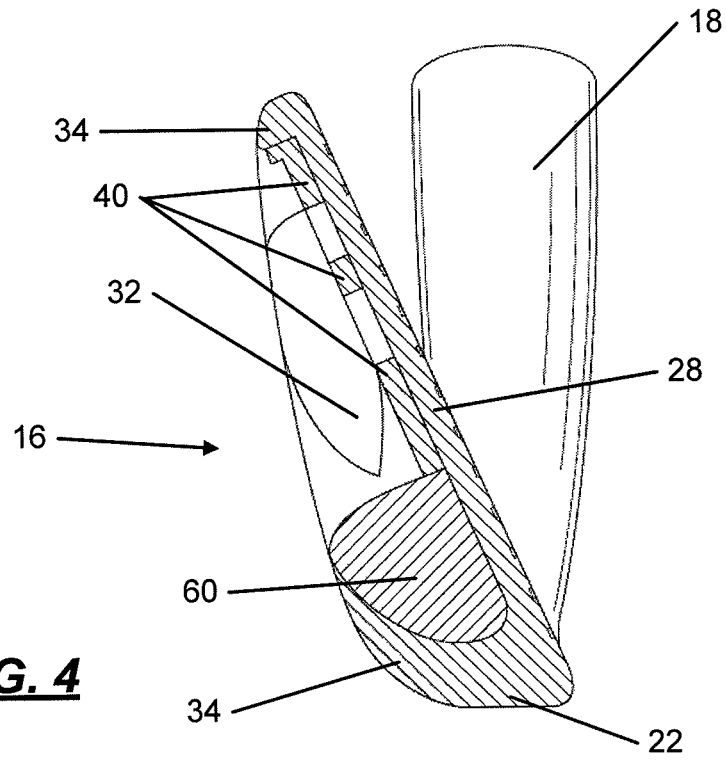
FIG. 4 illustrates a cross-sectional view of an example golf club head in accordance with the present invention.

As shown in FIGS. 2 and 3, the golf club head 16 comprises a body 17, that includes a heel 20, a toe 22, a top portion 24, and a sole portion 26; a striking face 28; a rear portion 30; a reinforcing structure 40; and a perimeter weighting member 34. The term "heel" of the club head body 17, as used herein, means the side of the club head body 17 at which the shaft 12 is mounted. The term "toe" of the club head body 17, as used herein, means the side of the club head body 17 opposite the side that the shaft 12 is mounted. FIG. 4 shows a cross-section of the example club head in FIGS. 2 and 3.

A wide variety of club head constructions are possible without departing from this disclosure. For example, if desired, some or all of the various individual parts of the club head body 17 described above may be made from multiple pieces that are connected together (e.g., by adhesives or cements; by welding, soldering, brazing, or other fusing techniques; by mechanical connectors; etc.). The various parts (e.g., top portion 24, sole portion 26, etc.) may be made from any desired materials and combinations of different materials, including materials that are conventionally known and used in the art, such as metal materials, including lightweight metal materials, composite materials, polymer materials, steel, titanium, aluminum, tungsten, magnesium, beryllium, alloys including one or more of these metals, carbon-fiber reinforced materials, glass-fiber reinforced materials, graphite, etc.

Additionally, the club head 16 may be constructed in any suitable or desired manner and/or from any suitable or desired materials without departing from this disclosure, including from conventional materials and/or in conventional manners known and used in the art. The club head 16 and its various parts may be made by forging, casting, molding, and/or using other techniques and processes, including techniques and processes that are conventional and known in the art.

The dimensions and/or other characteristics of a golf club head 16 according to examples of this disclosure may vary significantly without departing from the disclosure. For example, any iron type club head may be provided including for example, iron type hybrid clubs, driving irons, 1 through 9 irons, wedges (e.g., pitching wedges, lob wedges, gap wedges, sand wedges, etc.), and chipping clubs.

During the game of golf, the golfer holds the grip 14 and swings the golf club 10 such that the golf club head 16 traverses a generally arcuate path and impacts a golf ball. A portion of the momentum of the golf club 10, and particularly the momentum of the golf club head 16, is then transferred to the golf ball and propels the golf ball toward an intended target. The position of the impact zone of the golf club head has an influence upon whether the golf ball curves right, curves left, or follows a generally straight route. More specifically, the golf ball follows a generally straight route when the center of gravity is positioned behind the point of engagement on striking face 28. When the center of gravity is spaced to one side of the point of engagement, however, the golf ball may follow a route that curves left or right. The position of the center of gravity of golf club head 16 also has an influence upon whether the golf ball exhibits a boring or climbing trajectory, depending upon whether the center of gravity is spaced above or below the point of engagement on striking face 28.

Although the concepts behind utilizing a golf club to propel a golf ball toward an intended target appear simplistic, the actual practice of propelling the golf ball in an intended manner is exceedingly complex. The golf ball may, for example, consistently curve right when, in fact, the individual intends to propel the golf ball along a straight route. Many conventional golf club heads 16 have a center of gravity located at the striking face 28. However, changing the position of the center of gravity of the golf club head 16 for different golf clubs may assist many golfers in squaring the club head face upon impact with a golf ball and/or getting the ball airborne. The positioning of the center of gravity off of the striking face 28 and toward the rear of the golf club head 16 may help many golfers who struggle to square the club face at impact (e.g., may help propel the ball straighter, in the intended direction, and may help get the ball airborne). Accordingly, golfers may be able to correct or modify the route of the golf ball by using the golf club head 16 of the present invention as the center of gravity of golf club head 16 is repositioned with respect to striking face 28 as compared to other golf club heads.

The center of gravity of golf club head 16, otherwise referred to as the center of mass, is defined as an equilibrium point. More specifically, the center of gravity of golf club head 16 is a point at which the entire weight of golf club head 16 may be considered as concentrated so that, if supported at that point, head 16 would remain in static equilibrium in any position. The location of the center of gravity of golf club head 16 may be changed by altering the weight distribution of the golf club head 16 by adding weight low and in the rear portion of the club head. Altering the weight distribution of the golf club head 16 may be accomplished, in accordance with at least some examples of this invention, with the use of a thin striking face 28 and a reinforcing member 40 as described below. The weight savings generated from using both the thin striking face 28 (as compared to a striking face of conventional thickness) and the reinforcing member 40 can then be placed in a location to alter the weight distribution to improve the playing characteristics of the golf club 10.

As is shown in FIG. 2, the striking face 28 is located between the top portion 24 and the sole portion 26, and between the heel 20 and the toe 22. The striking face 28 of the present invention is generally a thin face to help reduce the overall weight of the golf club 10. Generally, a conventional striking face is normally approximately at least 0.125 inches thick, while weighing at least 80 grams. The striking face 28 of the present invention may be as thin as 0.06 inches and may weigh 45 grams or less. In some example club head in accordance with this invention, the striking face 28 will include at least some portions with thicknesses in the range of 0.05 to 0.1 inches, and in some more specific examples, within the range of 0.06 to 0.08 inches.

Additionally, the striking face 28 of the present invention may have a variable thickness such that some area is thin while other areas are thicker. For example, in one aspect of the invention, the top of the striking face may be thin, such as 0.06 inches, and the bottom of the striking face may remain as thick as conventional striking faces. Another aspect of the invention may have the inner area of the striking face thin, such as 0.08 inches, and the outer area of the striking face thicker. A variety of combinations of thin and thick areas may be provided for the striking face without departing from this invention.

The striking face 28 provides a contact area for engaging and propelling a golf ball in an intended direction. The striking face 28 comprises horizontal grooves 29 for the removal of water and grass from the striking face during impact with a golf ball. The horizontal grooves 29 also help to impart spin to the golf ball so that the golfer may control the flight and/or landing characteristics of the golf ball.

FIG. 3 illustrates a rear view of an example golf club head 16 according to this invention. The golf club head 16 of this example structure includes a rear portion 30 positioned opposite the striking face 28 (which may simply constitute the rear surface of the striking face 28).

As seen in FIG. 3, the golf club head 16 may include the perimeter weighting member 34. The perimeter weighting member 34 may extend rearward from the striking face 28 and along at least a portion of the circumferential area of the rear portion 30. If desired, the perimeter weighting member 34 may extend around the entire circumferential area of the rear portion 30. The perimeter weighting member 34 defines a rear cavity 32 having a large opening extending toward the rear portion 30 and away from a rear surface of the ball striking face 28. In order to provide sufficient durability for the thin striking face 28 as described above, one or more reinforcing structures 40 may be utilized.

2. Reinforcing Structures According to Examples of this Invention

As is illustrated in FIG. 3, the reinforcing structure 40 fits within the rear cavity 32 and may extend across the rear cavity 32. The reinforcing structure of the present invention may provide many advantages over previous structures in cavity back irons. The reinforcing structure 40 provides the benefit of providing adequate support to the ball striking face 28 during impact by increasing the face stiffness and the strength of the ball striking face 28. Additionally, the reinforcing structure 40 provides this support by saving weight, so that the center of gravity may be moved to alter the weight distribution to improve the playing characteristics of the golf club 10.

The reinforcing structure 40 may be engaged with the rear surface of the striking face. Additionally, the reinforcing structure 40 may be completely bonded to the rear portion 30 of the face and the upper portion of the perimeter weighting member 34 where it contacts. The reinforcing structure 40 may be bonded to one or more other portions of the club head using adhesives or cements; via welding soldering, brazing, or the like. Alternatively, if desired, the reinforcing structure 40 may be connected to one or more other portions of the club head 16 via one or more mechanical connectors (such as threads, retaining elements, etc.).

Also, in some example club head structures according to this invention, the reinforcing structure 40 may be wedged between the inner walls of the rear portion 30 of the face and the perimeter weighting member 34. This wedging may provide additional support to the bonding or connecting as described above. Additionally, depending on the structure of the club head 16, the reinforcing structure 40 may be wedged between the inner walls of the rear portion 30 of the face and a discretionary weight 60 (as will be described below in more detail). Once again, this wedging may provide additional support to the bonding or connecting. The reinforcing structure 40 may be wedged between any of the structures on the rear portion 30 of the face without departing from this invention.

Similar to the workings of a bridge, the reinforcing structure 40 may be cored-out to reduce as much weight as possible while keeping its structural integrity. This reinforcing structure 40 can be made of any light-weight material, such as aluminum, magnesium, beryllium, aluminum alloys, magnesium alloys, beryllium alloys, polymers (e.g., PEBAX® (a polyether-block co-polyamide polymer available from Atofina Corporation of Puteaux, France), thermoplastic polymers, thermosetting polymers, etc.), carbon fiber reinforced polymers, glass reinforced polymers, etc. In at least some example structures according to this invention, as much weight as possible will be removed from the reinforcing structure 40, while maintaining the structural integrity of both the reinforcing structure 40 and the club head face 28 for the intended and expected use.

Figure 3A:
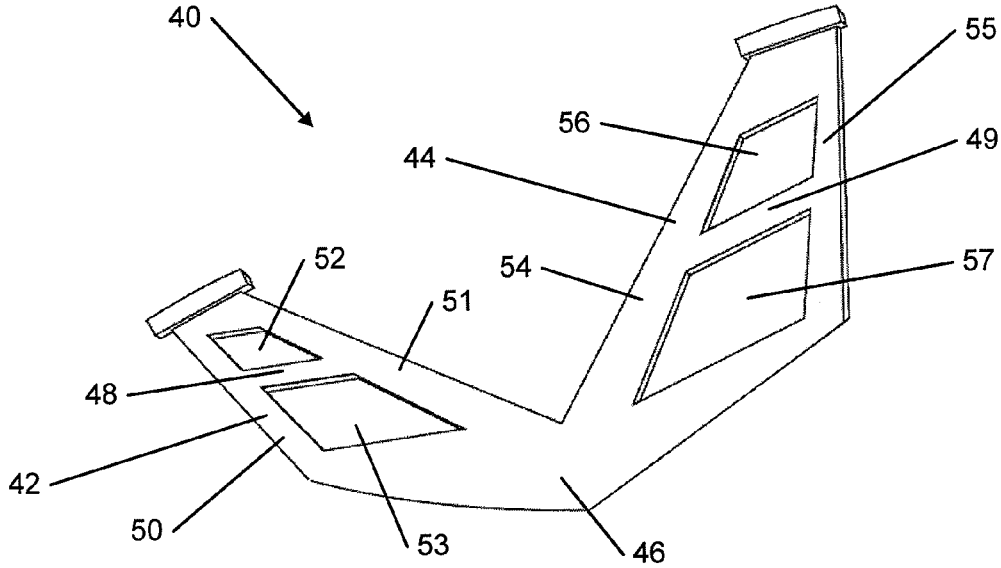
FIG. 3A illustrates a close-up view of an example reinforcing structure for the golf club head as illustrated in FIG. 3 in accordance with the present invention.

The reinforcing structure 40, as shown in FIG. 3 and a close-up shown in FIG. 3A, may include a first truss member 42 (e.g., a heel truss member), a second truss member 44 (e.g., a toe truss member), and a connecting member 46. The first truss member 42 and second truss member 44 may extend across at least a portion of the rear cavity 32 from the upper portion of the perimeter weight member 34 to the connecting member 46. The connecting member 46 may be located along the rear portion 30 at a location generally directly behind a preferred ball impact zone 48 between the club head face 28 and a ball during use. The preferred impact zone 48 may be located at a medial location of the striking face 28 bounded in a vertical perspective between the top portion 24 and bottom portion 26 and in a horizontal perspective between the heel 20 and the toe 22. With many clubs, it is desirable to hit a golf ball on the preferred impact zone 48 as this zone may be located in line with the center of gravity (or center of mass) of the club head. Golf balls hit within this impact zone 48 may have truer flights and travel longer distances than off-center shots. Hitting the ball slightly off-center on the striking face 28 may create problems with control of the direction and/or flight of the golf ball.

In one example structure according to this invention, as shown in FIGS. 3 and 3A, the first truss member 42 may include a first pair of beams 50, 51 extending from the connecting member 46 to the upper portion of the perimeter weighting member 34. The first pair of beams 50, 51 may be non-parallel, as shown in FIGS. 3 and 3A. The first pair of beams 50, 51 need not intersect or meet at the connecting member 46. Additionally, the first pair of beams 50, 51 need not intersect or meet at the upper portion of the perimeter weighting member 34. Each of the beams 50, 51 may be connected by at least one cross-beam 48. The cross-beam 48 may be located approximately equidistant between the connecting member 46 and the upper portion of the perimeter weighting member 34 (or at another desired location). The connection of the cross-beam 48 between the first pair of beams 50, 51 thereby creates two openings 52, 53 for the first truss member 42.

Additionally, the second truss member 44 may include a second pair of beams 54, 55 extending from the connecting member 46 to the upper portion of the perimeter weighting member 34. The second pair of beams 54, 55 may be non-parallel as shown in FIGS. 3 and 3A. The second pair of beams 54, 55 need not intersect or meet at the connecting member 46. Additionally, the second pair of beams 54, 55 need not intersect or meet at the upper portion of the perimeter weighting member 34. Each of the beams 54, 55 may be connected by at least one cross-beam 49. The cross-beam 49 may be located approximately equidistant between the connecting member 46 and the upper portion of the perimeter weighting member 34 (or at another desired location). The connection of the cross-beam 49 between the second pair of beams 54, 55 thereby creates two openings 56, 57 for the second truss member 44.

While the truss members 42, 44 in FIG. 3 are in a specific position, it is possible that the positions of the truss members 42, 44 may be selectively controlled such that the area between the first truss member 42 and the second truss member 44 is located so as to provide an area that improves corresponding ball speed at impact. For example, to take better advantage of the coefficient of restitution (COR), the ball should hit on the most flexible area of the striking face 28. If a user tends to hit the ball predominantly at a relatively small area of the striking face 28 (e.g., as determined from repeated ball hits using impact tape or other impact location determining technology), providing the truss members 42, 44 away from this area may improve the COR response of the striking face 28 for the user.

3. Discretionary Weight According to Examples of this Invention

According to some aspects of this disclosure, a discretionary weight 60 may be added or attached to the perimeter weighting member 34. The discretionary weight 60 may also be integrally formed as part of the club head structure, by providing more dense materials where desired, such as at the heel 20 and/or the toe 22. The discretionary weight 60 may be added at the toe portion 22 and may be placed low and in the rear portion 30 of the golf club head 16. This discretionary weight 60 may include at least sufficient weight corresponding to the weight savings provided by including openings 52, 53, 56, 57 in the reinforcing structure 40 (as compared to the same reinforcing structure size and shape without the openings). Additionally or alternatively, the discretionary weight 60 may consist of at least sufficient weight corresponding to the weight savings provided by using the thin striking face 28

(as compared to a face of conventional thickness). The more weight savings that can be gained from the openings 52, 53, 56, 57 and/or from the thin striking face 28, the more discretionary weight 60 that can be placed low and/or in the toe portion 22 or heel portion 20 of the club head 16.

The discretionary weight 60 may be at least 4 grams or within a range of 5 grams to 30 grams. The discretionary weight member 60 may be made of a material selected from the group consisting of lead, tungsten, lead alloys, tungsten alloys, other metal materials that include lead, other metal materials that include tungsten, polymeric materials that include lead, and polymeric materials that include tungsten.

Adding the discretionary weight 60 low and in the rear portion 30 of the club head 16 at the toe 22 may help to do two things. First, adding the discretionary weight 60 low and in the rear portion 30 may increase the moment of inertia (MOI) of the club head 16, which is known to increase the distance and/or accuracy for off-center shots (because the club head better resists twisting about the vertical axis and/or loss of velocity due to off-center hits). Second, adding the discretionary weight 60 low and in the rear portion 30 may lower the center of gravity for the golf club 10, making the center of gravity closer to the sole portion 22 of the club and/or closer in line to the impact zone 48. Making the center of gravity low and/or closer in line to the impact zone 48 will improve distance, improve the chance for solid connections, and make it easier to get the ball airborne. The discretionary weight 60 may be made of a heavy material, such as lead, tungsten, lead alloys, tungsten alloys, other metals or polymers that include lead or tungsten materials therein, etc.

Additionally, the discretionary weight 60 may be incorporated into other locations of the club head, such as in the perimeter weight member, especially at the sides and bottom. The discretionary weight 60 also may be added as a separate element as described above or it may be provided: (a) by "beefing up" the various locations of the club head structure (e.g., the sides and bottom of the perimeter weight), (b) by selecting denser materials for various locations of the club head structure (e.g., the sides and bottom of the perimeter weight), etc.

4. Additional Reinforcing Structures According to Examples of this Invention

Figure 5:
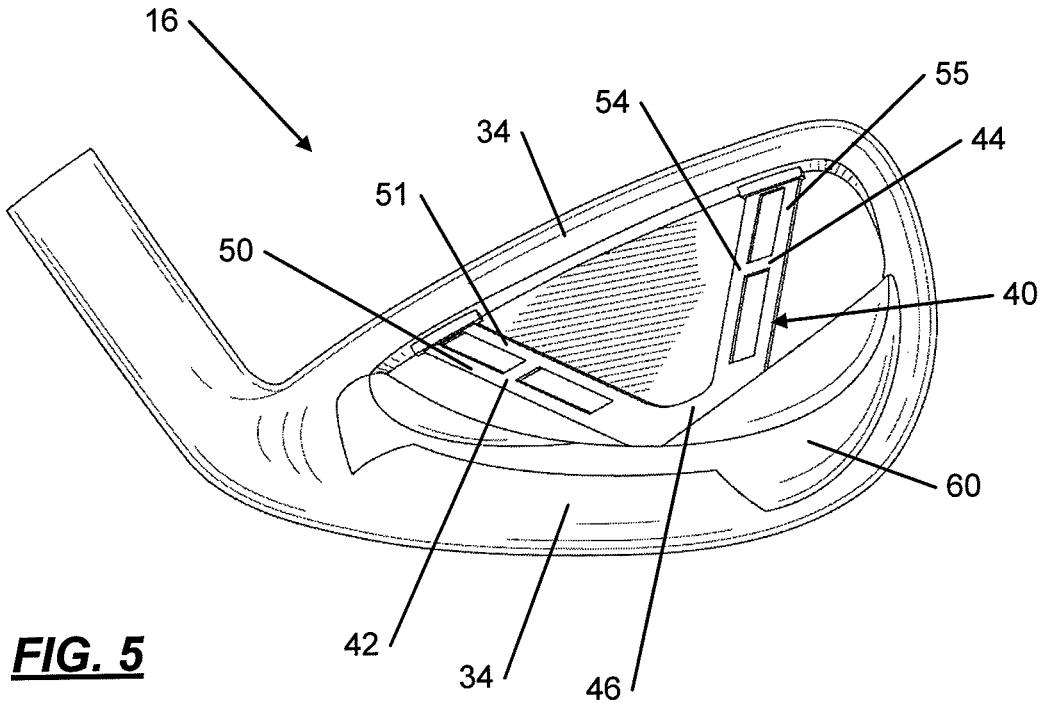
FIGS. 5-16 illustrate rear views of various examples of golf club heads in accordance with the present invention.

As shown in FIG. 5, in another example club head structure 16 according to this invention, the first pair of beams 50, 51 from the first truss member 42 may be parallel. Additionally the second pair of beams 54, 55 from the second truss member 44 may be parallel. Alternatively, only one of the pairs of beams may be parallel.

Figure 6:
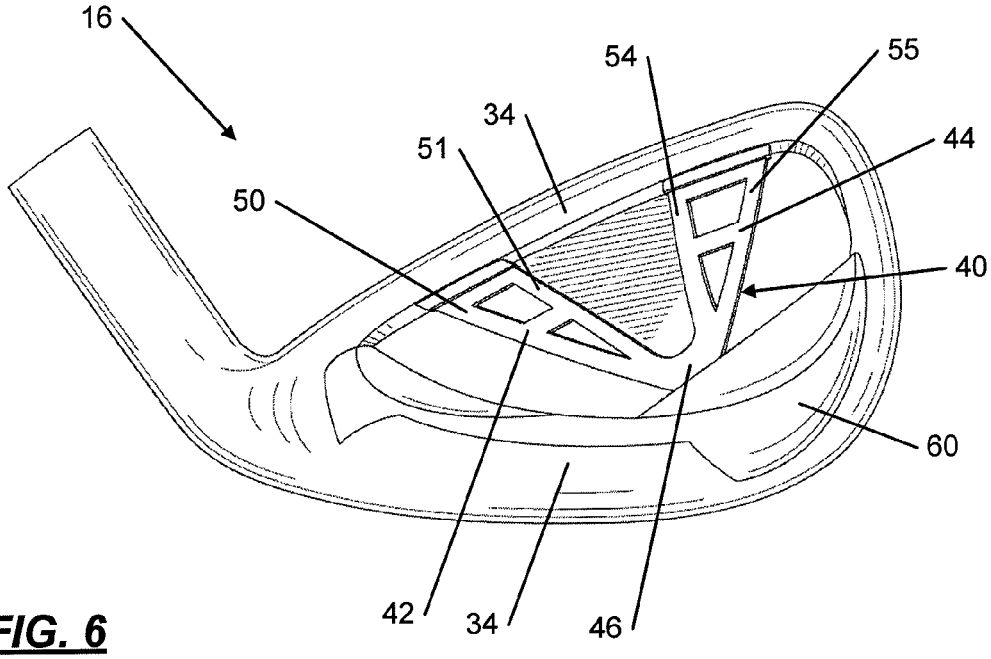

Additionally, as shown in FIG. 6, the first pair of beams 50, 51 from the first truss member 42 may be non-parallel. As is shown in FIG. 6, the first pair of beams 50, 51 may meet at the connecting member 46, thereby creating an inverted "A"-shaped truss member. Also, the second pair of beams 54, 55 from the second truss member 44 may be non-parallel. As is shown in FIG. 6, the second pair of beams 54, 55 may meet at the connecting member 46, thereby creating an inverted "A"-shaped truss member. Lastly, both pairs of beams may be non-parallel and meet at the connecting member 46.

Figure 7:
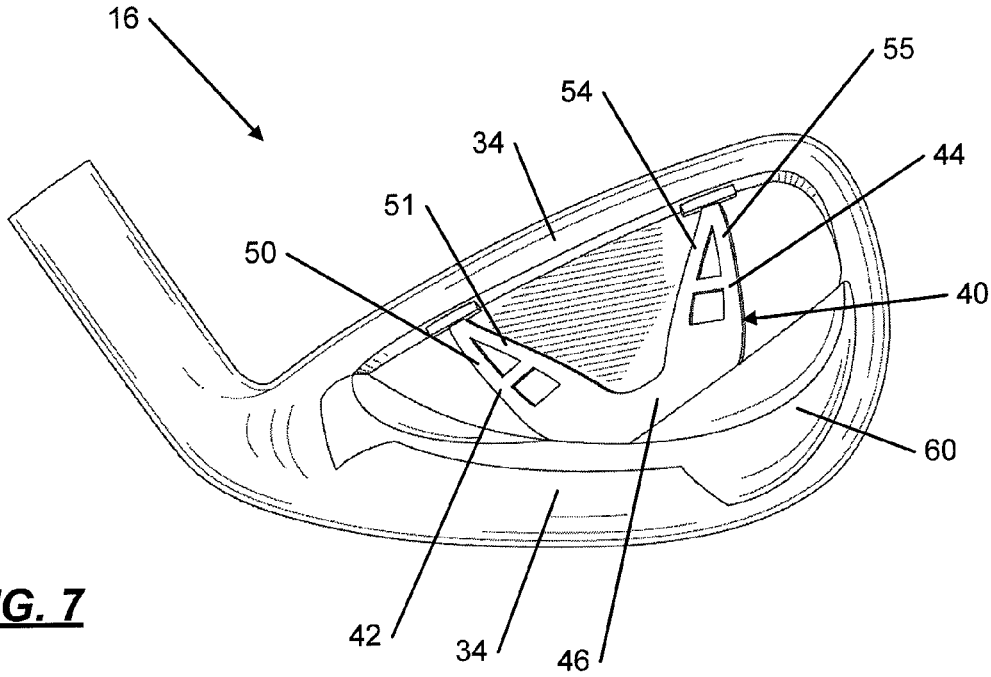

As shown in FIG. 7, the first pair of beams 50, 51 from the first truss member 42 may be non-parallel and may meet at the upper portion of the perimeter weighting member 34, thereby creating an "A"-shaped truss member. Additionally, as shown in FIG. 7, the second pair of beams 54, 55 from the second truss member 44 may be non-parallel and may meet at the upper portion of the perimeter weighting member 34, thereby creating an "A"-shaped truss member. Lastly, both pairs of beams may be non-parallel and meet at the top portion 24.

Figure 8:
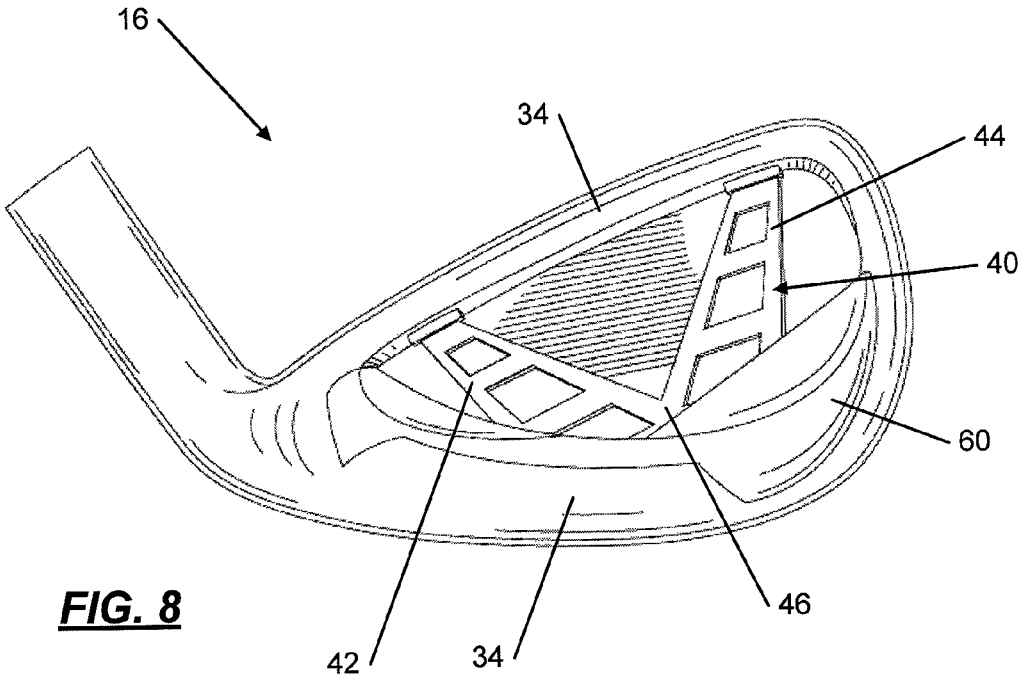

In another example structure as shown in FIG. 8, there may be two cross-beams on the first truss member 42, the second truss member 44, or both truss members. A first cross-beam may be located connecting the lower third of the pair of beams, while the second cross-beam may be located connecting the upper third of the pair of beams. The connection of these two cross-beams would thereby create three openings on each truss. Additionally, more cross-beams may be used as allowed and required to maintain the structural integrity of the durable thin striking face 28. A variety of different opening sizes and/or shapes may be provided without departing from this invention. Additionally, the various truss members may have the same or different opening specifications and/or arrangements from one another without departing from this invention.

Figure 9:
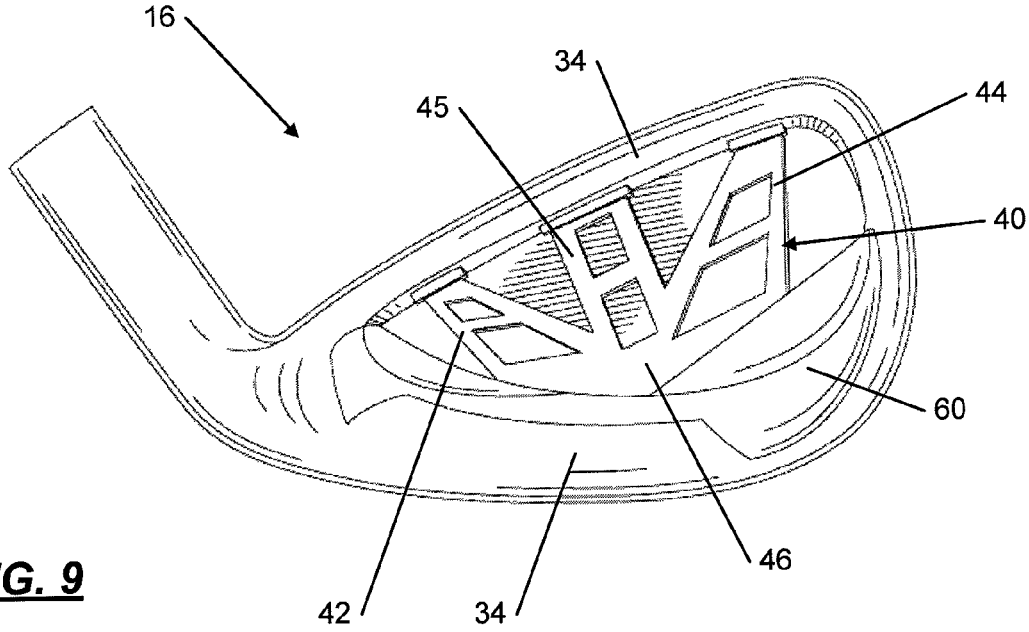

Additionally, there may be more than two truss members extending from the connecting member 46. As shown in FIG. 9, the reinforcing structure 40 includes a first truss member 42, a second truss member 44, and a third truss member 45. The third truss member 45 may extend from the connecting member 46 to the upper portion of the perimeter weighting member 34 and may be located in between the first truss member 42 and the second truss member 44.

Figure 10A:
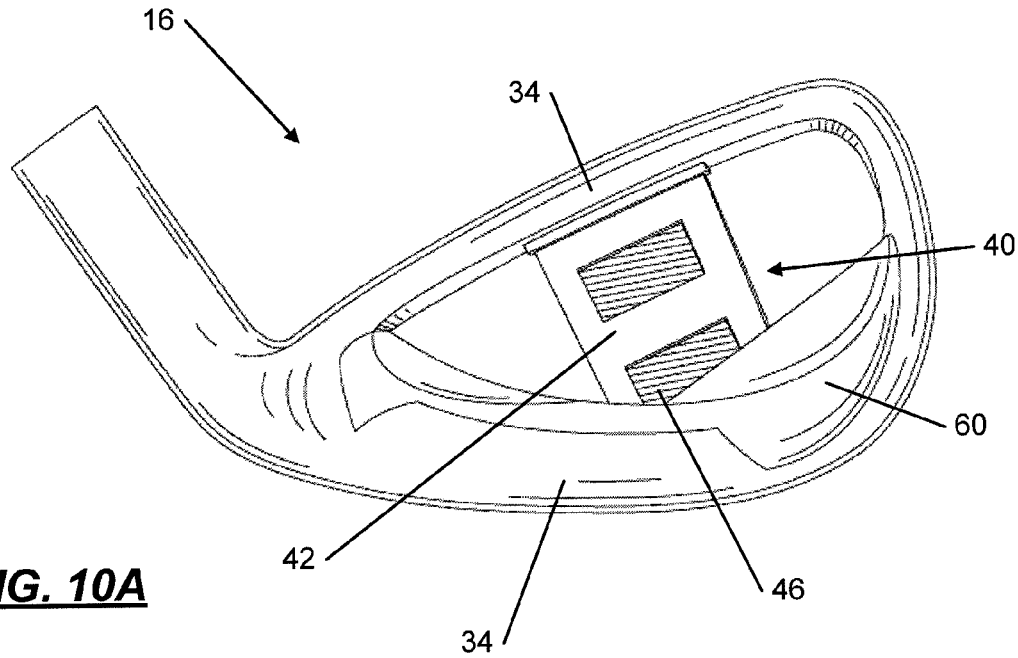
Figure 10B:
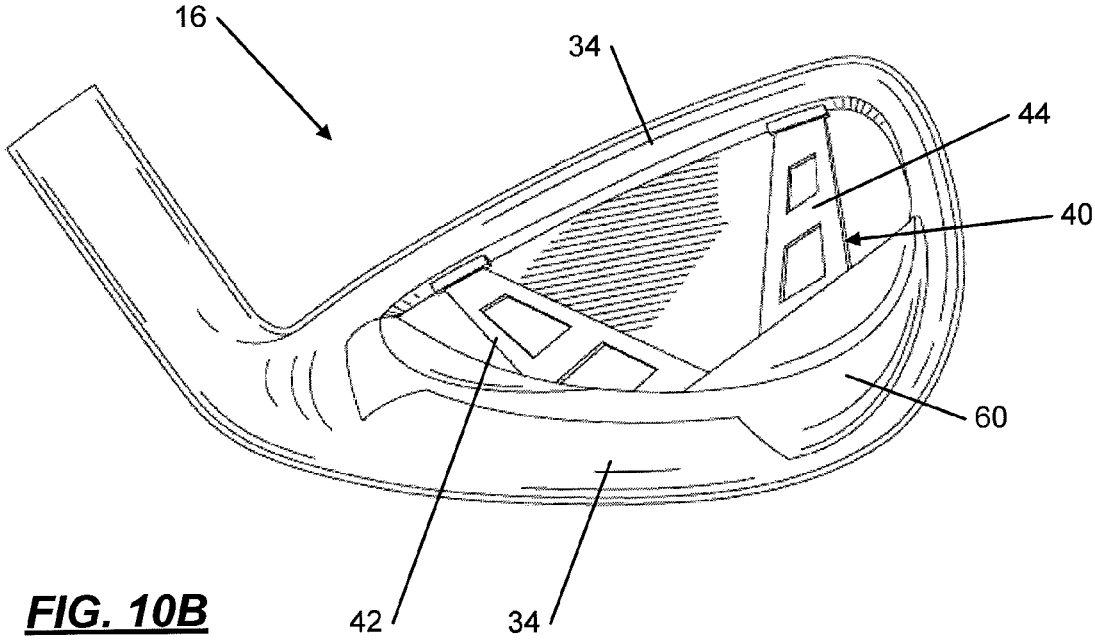
Figure 10C:
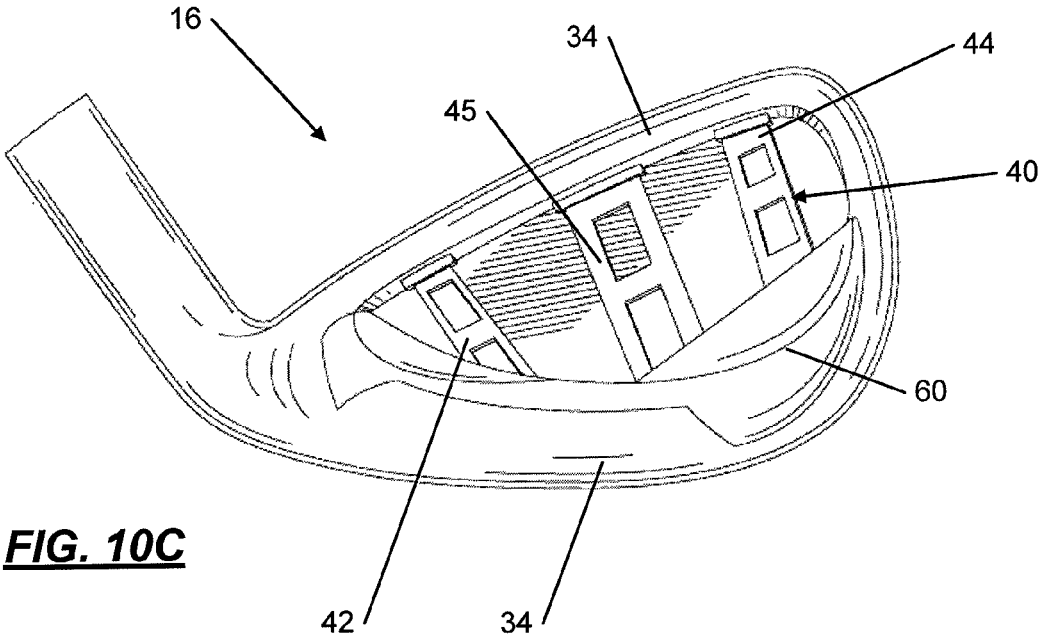

Additionally, the reinforcing structure 40 need not include the connecting member 34 and may only include truss members, for example, as shown in FIGS. 10A-C. In FIG. 10A, the reinforcing structure 40 includes only one truss member 42. In FIG. 10B, the reinforcing structure 40 includes two truss members 42, 44. In FIG. 10C, the reinforcing structure 40 includes three truss members 42, 44, 45.

Figure 11:
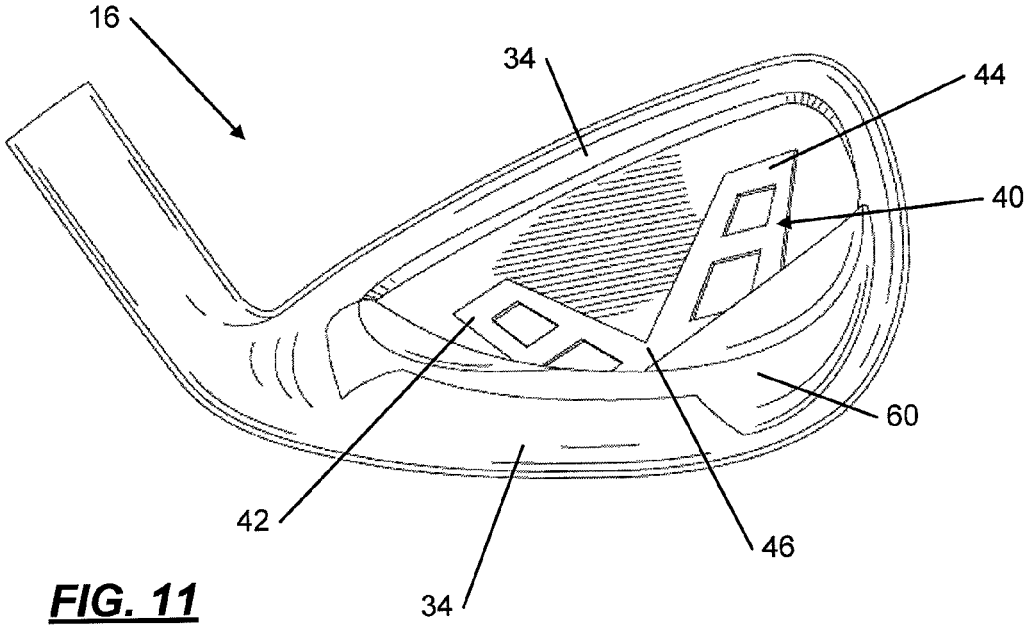
Figure 12A:
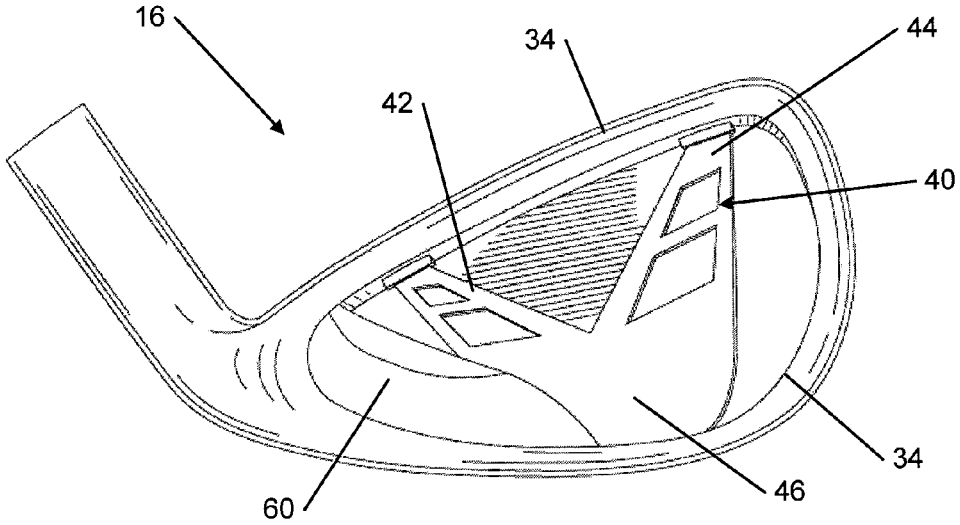
Figure 12B:
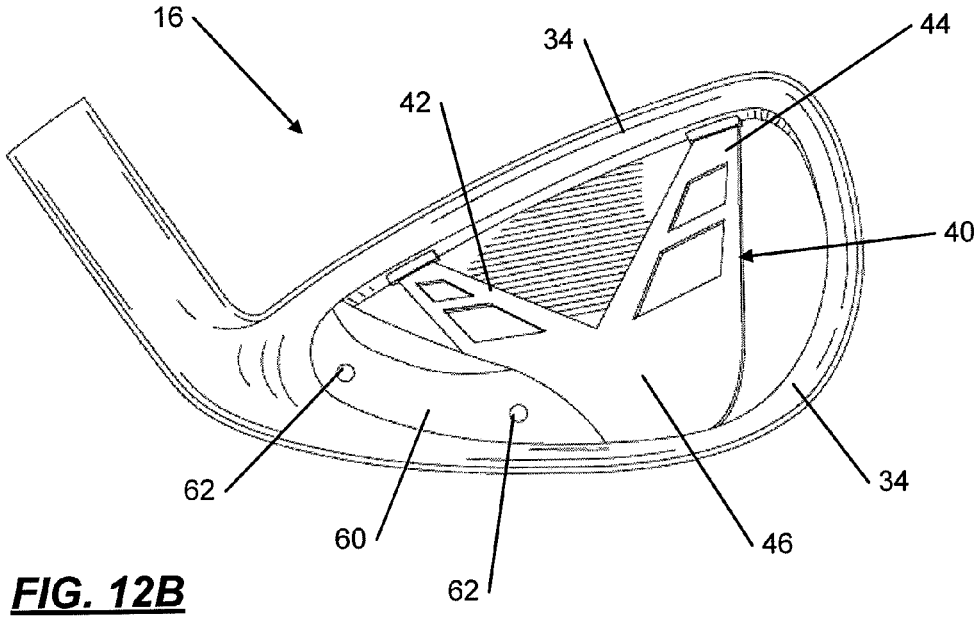
Figure 13A:
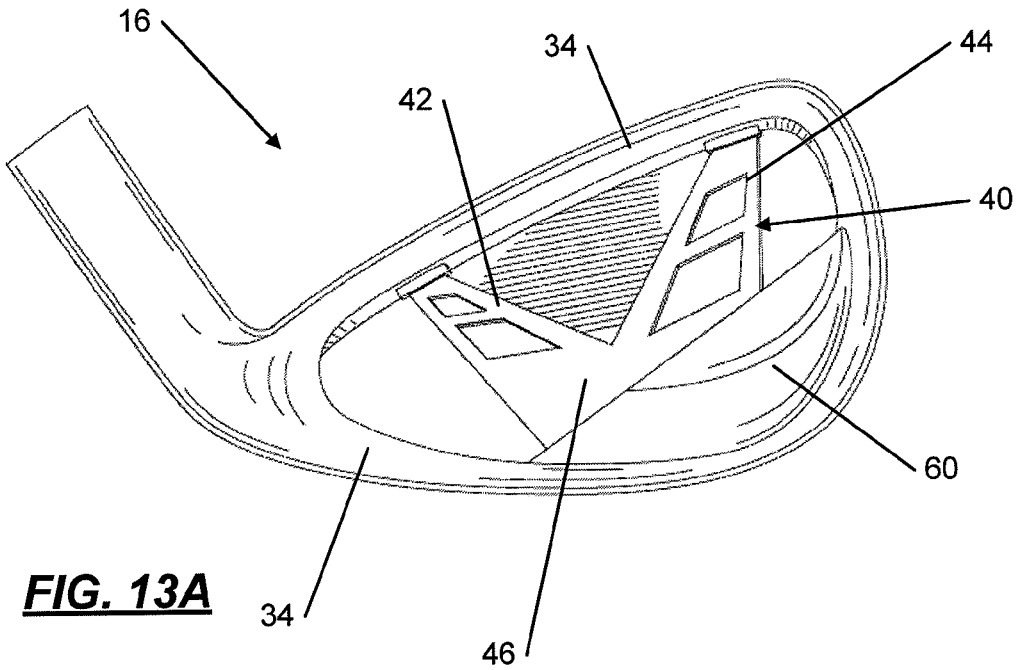
Figure 13B:
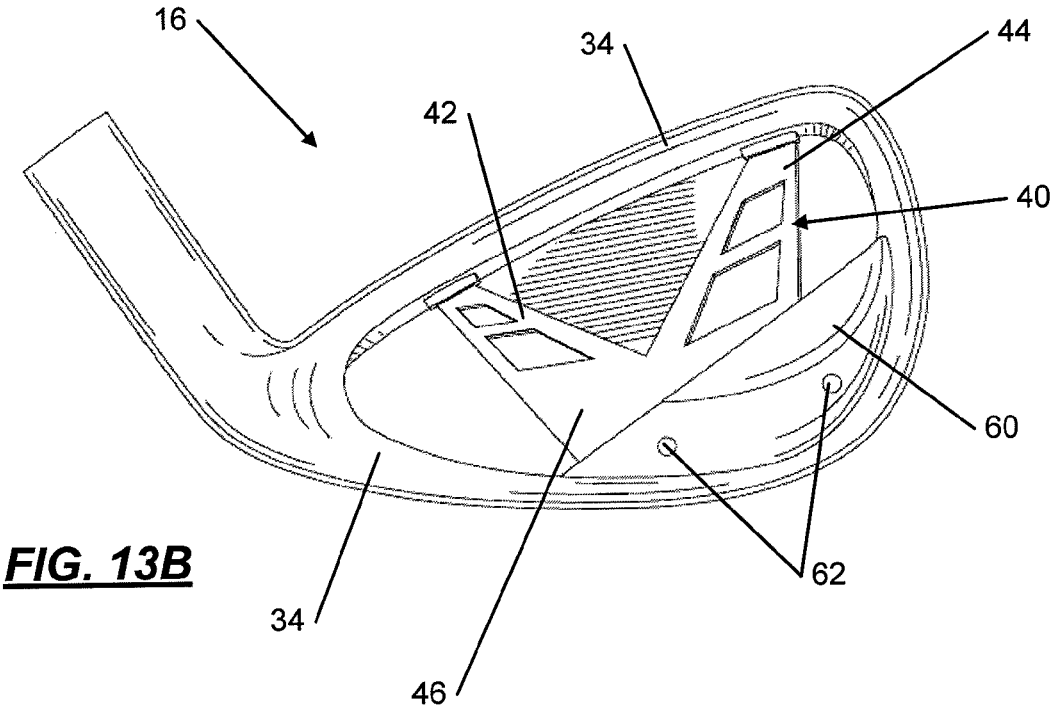

Additionally, the reinforcing structure 40 may include truss members that do not extend all the way to the upper portion of the perimeter weighting member 34. As shown in FIG. 11, the truss members 42, 44 do not extend to the upper portion of the perimeter weighting member 34.

Any of the above configurations of the reinforcing structure 40 may provide adequate reinforcement for the thin striking face 28, while also reducing as much weight as possible and maintaining the structural integrity of the golf club head 16.

5. Additional Discretionary Weight Configurations According to Examples of this Invention Further it is noted that while the depicted example structure shown in FIG. 3 demonstrates one placement of the discretionary weight 60 and one example of this disclosure, this is not to suggest that other variations are not contemplated within the scope of this disclosure. In fact, other desired variations may be provided without departing from this disclosure.

Figure 14:
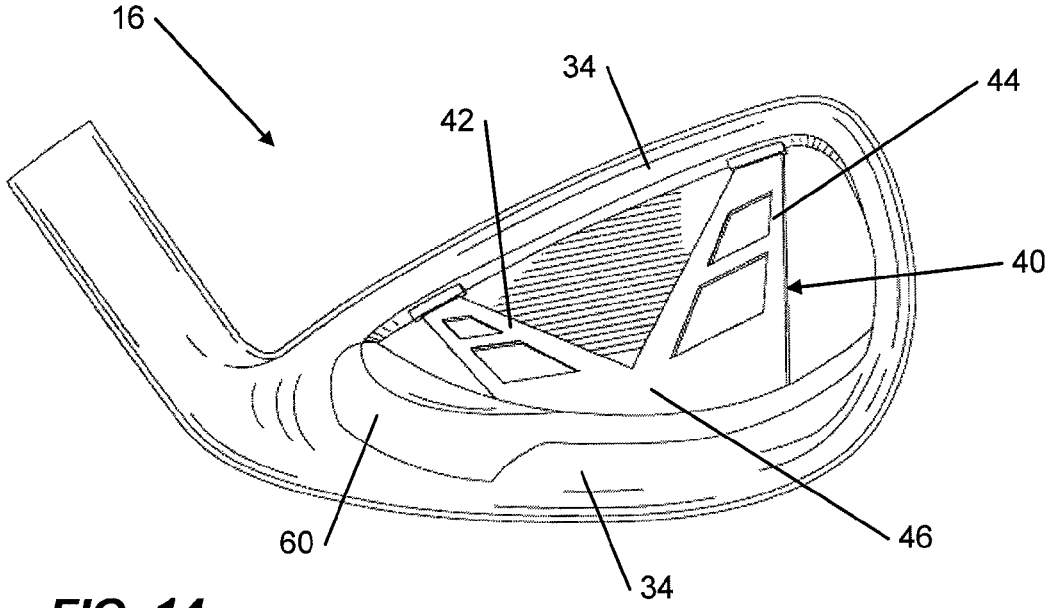
Figure 15:
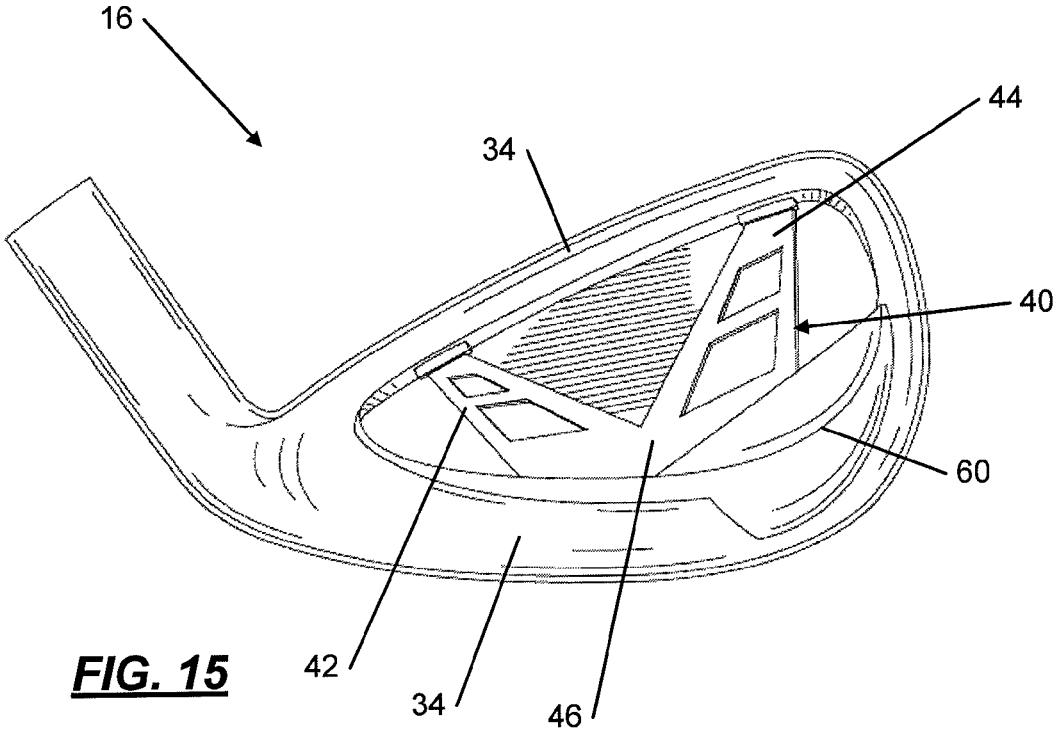
Figure 16:
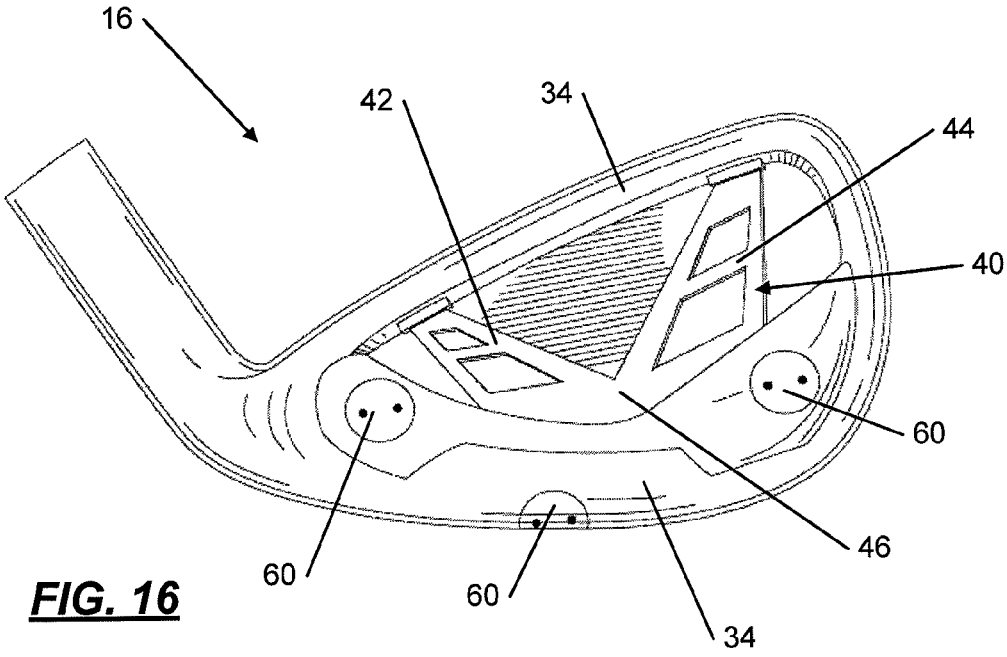

As shown in FIGS. 12-15, the discretionary weight 60 may be provided at different locations on the club head 16. For example, in FIG. 12A, the discretionary weight 60 is located at the heel 20 of the club head 16. In FIG. 13A, the discretionary weight 60 is located at the toe 22 of the club head 16. FIGS. 12B and 13B show a set of screws or fasteners 62 that may be utilized to selectively attach differently weighted discretionary weights 60. In FIG. 14, the discretionary weight 60 is located mostly in the heel portion 20 of the club head 16. In FIG. 15, the discretionary weight 60 is located mostly in the toe portion 22 of the club head 16. Additionally, as shown in FIG. 16, the discretionary weights 60 may be screw-in type weights that may be inserted into weight ports located at various positions around the club head 16. The discretionary weights 60 could be of different masses. For example, with 3 weights, there may be an 8 gram weight, a 12 gram weight, and a 16 gram weight, or any other combination of masses without departing from the present invention. The club fitter or user could selectively toe weight, heel weight, etc., based on the weights chosen for the various weight ports. By varying the location of the discretionary weight 60 on the club head 16 can provide many advantages.

Additionally, as stated above, the discretionary weight can be located in different positions to alter the weight distribution of the golf club head 16. By altering the weight distribution of the golf club head 16, the club head's 16 center of gravity may be located in a more desirable position.

For example, during a club fitting, a set of clubs with the discretionary weight 60 in different locations on the club head 16 can be used. The discretionary weight 60 can be selectively located in different locations (e.g., near the heel 20 in "long" irons to the toe 22 in "short" irons) to better conform to a particular golfer's swing or tendencies. For example during a club fitting, in order to analyze a particular golfer's swing, tendencies, characteristics, etc., a club fitter could use a variety of techniques including: observation with the naked eye of either the swing and/or the golfer's body throughout the swing; recording and play back (e.g., in slow motion or real time) of the swing and/or the golfer's body throughout the swing; measurement of particular aspects of the swing including: the angle of the club head and/or the shaft throughout the swing (e.g., at the take away, during the downswing, at impact, during the follow through, etc.), velocity or acceleration of the club head throughout the swing, etc.; computer analysis of the swing, such as computer analysis of the above mentioned measurements and recordings; etc. Upon analyzing the particular golfer's swing or tendencies (e.g., in a manner described above), a club fitter could selectively attach a club head 16 with the discretionary weight 60 to the shaft 12 based on the analysis of at least one characteristic of a golfer's swing in a manner to better aid a particular golfer achieve a desired result. Therefore, the club fitter may exchange or replace the existing club head 16 with other interchangeable club heads 16 in order to better aid a particular golfer achieve a desired result. For example, if a golfer has a tendency to "slice", then the club fitter may attach a club head 16 with the discretionary weight 60 that provides more mass in the heel 20. Conversely, if a golfer has a tendency to "hook" the golf ball, then the club fitter may attach a club head 16 with the discretionary weight 60 that provides more mass in the toe 22.

Figure 17:
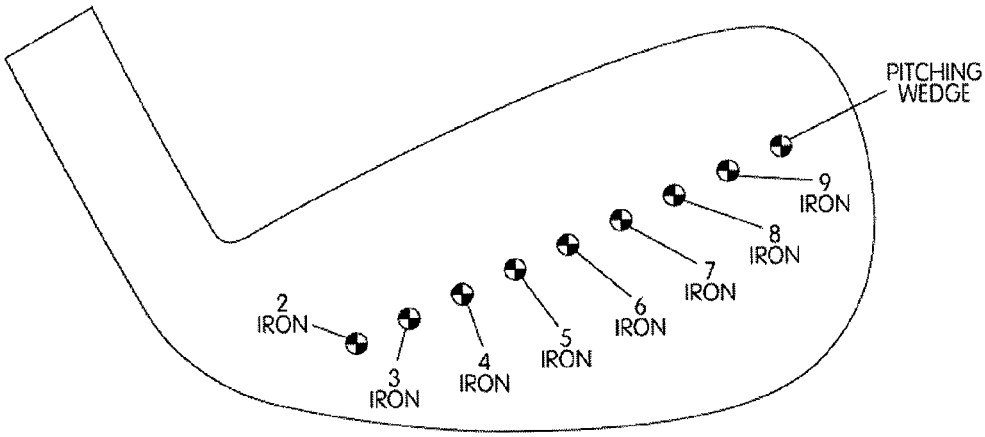
FIG. 17 schematically shows a progression of the center of gravity of a golf club head in a set of golf clubs in accordance with the present invention.

Additionally, various irons in a set may have different reinforcing structures 40 and/or different discretionary weights 60 to differently position the center of gravity of the club head 16. FIG. 17 schematically shows an entire exemplary progression of the position of the center of gravity in a set of golf clubs according to an illustrative embodiment of this disclosure. It is noted that the schematic rendering shown in FIG. 17 is not to scale and, instead, is used merely to give the reader a sense of the general progression of the center of gravity for one embodiment of this disclosure. As seen in FIG. 17, the progression begins as a 2-iron (one of the club head bodies with a low degree of loft relative to the set of club head bodies) with the center of gravity located generally towards the lower heel end 20 of the club head 16. The progression continues from the lower heel 20 towards the upper toe 22 of the club head 16 until the progression ends as a pitching wedge (one of the club heads with a high degree of loft relative to the set of club heads) with the center of gravity located generally towards the upper toe end 22 of the club head 16. It is noted of course, that this is merely one illustrative embodiment of a set of golf clubs according to this disclosure and other sets of golf clubs according to this disclosure may include other clubs, such as sand wedges, lob wedges, hybrids irons, etc. Further, it is noted that other desired progressions or arrangements may be provided without departing from this disclosure.

These different locations of the center of gravity of the club heads 16 can affect the trajectory and ball flight of a golf ball struck by the golf club. Hence, it is understood that selectively positioning the reinforcing structure 40 and/or the discretionary weight 60 can produce a set of golf clubs with desirable characteristics. For example, a "long" iron of such a set of golf clubs has a club head 16 with a center of gravity near the hosel 18. Hence, such "long" irons can aid a golfer in imparting a "draw" trajectory to the golf ball and, therefore, provide characteristics of a "draw" shot (i.e., less backspin, further roll and lower ball flight) which will tend to increase the distance that the golf ball will travel upon being struck by the golfer. Conversely, a "short" iron of such a set of golf clubs has a club head 16 with a center of gravity near the toe 22. Hence, such "short" irons can aid a golfer in imparting "fade" trajectory to the golf ball and, therefore, provide characteristics of a "fade" shot (i.e., more backspin, less roll and higher ball flight) which tend to provide enhanced ball control (e.g., stopping the ball on the green).

As discussed above, the weighting features of golf club heads in accordance with this disclosure are not limited to controlling the horizontal position of the golf club's center of gravity (the horizontal position when the golf club is oriented at a ball addressing position). Rather, the center of gravity in the vertical direction also may be selectively controlled, if desired, in at least some examples of golf club head structures according to this disclosure. Increasing the weight in the top portion 24 of the club head 16 produces a higher center of gravity in the golf club head which can provide lower initial ball flight path, e.g., for play in windy conditions, to provide more "running" shots, etc. Conversely, increasing the weight in the sole portion 26 of the club head 16 produces a lower center of gravity in the golf club head which can provide a more lofted golf ball flight path, which can help a golfer get the ball in the air.

C. DETAILED DESCRIPTION OF ADDITIONAL ASPECTS OF THIS INVENTION

Method of Producing the Golf Club

Additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head 16 of the various types described above (including any or all of the various structures, features, and/or arrangements described above), e.g., by manufacturing or otherwise constructing the golf club head 16, by obtaining the golf club head 16 from a third party source, etc.; (b) engaging a shaft 12 with the golf club head 16; and (c) engaging a grip 14 with the shaft member 12.

D. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. A golf club head, comprising:

a striking face providing a front surface for engaging a golf ball and a rear surface opposite the front surface, wherein at least 50% of an overall surface of the striking face has a thickness from the front surface to the rear surface of no greater than 0.1 inches;

a perimeter weighting member extending rearward from the striking face and around at least a majority of a circumference of the striking face, wherein the perimeter weighting member at least partially defines a rear cavity in the golf club head; and a reinforcing structure at least partially located in the rear cavity, wherein the reinforcing structure includes a first truss member, a second truss member and a connecting member that connects the first truss member and the second truss member, wherein the first and second truss members extend from an upper portion of the perimeter weighting member to the connecting member that is located closer to a sole edge of the striking face than to a top edge of the striking face, and further wherein the first truss member includes a first pair of beams connected by a first cross-beam, wherein the first pair of beams extend from the connection member to the upper portion of the perimeter weighting member and the second truss member includes a second pair of beams connected by a second cross-beam, wherein the second pair of beams extend from the connection member to the upper portion of the perimeter weighting member.

2. The golf club head of claim 1, further comprising:

a discretionary weight engaged with the perimeter weighting member.

3. The golf club head of claim 2, wherein the discretionary weight is located at a toe portion of the golf club head.

4. The golf club head of claim 2, wherein the discretionary weight is at least 4 grams.

5. The golf club head of claim 1, wherein when the golf club head is soled and in a ball address orientation on a horizontal surface, the golf club head center of mass is less than 0.6 inches above the horizontal surface.

6. The golf club head of claim 5, wherein at least a portion of the connecting member is located between the center of mass and the striking face and less than 0.5 inches above the horizontal surface.

7. The golf club head of claim 1, wherein the reinforcing structure is engaged with the rear surface of the striking face.

8. The golf club head of claim 1, wherein the truss members each have at least one opening defined therein.

9. The golf club head of claim 1, wherein the truss members are made of a material selected from the group consisting of: aluminum, magnesium, beryllium, aluminum alloys, magnesium alloys, beryllium alloys, thermoplastic polymers, thermosetting polymers, carbon-fiber reinforced composite materials, and glass-fiber reinforced materials.

10. The golf club head of claim 1, wherein the discretionary weight is made of a material selected from the group consisting of lead, tungsten, lead alloys, tungsten alloys, other metal materials that include lead, other metal materials that include tungsten, polymeric materials that include lead, and polymeric materials that include tungsten.

11. An iron-type golf club, comprising:

a shaft;

a grip attached to the shaft; and a golf club head configured to receive the shaft, wherein the golf club head further includes:

a striking face providing a front surface for engaging a golf ball and a rear surface opposite the front surface, wherein at least 50% of an overall surface of the striking face has a thickness from the front surface to the rear surface of no greater than 0.1 inches;

a perimeter weighting member extending rearward from the striking face and around at least a majority of a circumference of the striking face, wherein the perimeter weighting member at least partially defines a rear cavity in the golf club head; and a reinforcing structure at least partially located in the rear cavity, wherein the reinforcing structure includes a first truss member, a second truss member and a connecting member that connects the first truss member and the second truss member, wherein the first and second truss members extend from an upper portion of the perimeter weighting member to the connecting member that is located closer to a sole edge of the striking face than to a top edge of the striking face, and further wherein the first truss member includes a first pair of beams connected by a first cross-beam, wherein the first pair of beams extend from the connection member to the upper portion of the perimeter weighting member and the second truss member includes a second pair of beams connected by a second cross-beam, wherein the second pair of beams extend from the connection member to the upper portion of the perimeter weighting member.

12. The golf club of claim 11, further comprising:

a discretionary weight engaged with the perimeter weighting member.

13. The golf club of claim 12, wherein the discretionary weight is located at a toe portion of the golf club head.

14. The golf club head of claim 12, wherein the discretionary weight is at least 4 grams.

15. The golf club of claim 11, wherein when the golf club head is soled and in a ball address orientation on a horizontal surface, the golf club head center of mass is less than 0.6 inches above the horizontal surface.

16. The golf club of claim 15, wherein at least a portion of the connecting member is located between the center of mass and the striking face and less than 0.5 inches above the horizontal surface.

17. The golf club of claim 11, wherein the reinforcing structure is engaged with the rear surface of the striking face.

18. The golf club of claim 11, wherein the truss members each have at least one opening defined therein.

19. The golf club of claim 11, wherein the truss members are made of a material selected from the group consisting of: aluminum, magnesium, beryllium, aluminum alloys, magnesium alloys, beryllium alloys, thermoplastic polymers, thermosetting polymers, carbon-fiber reinforced composite materials, and glass-fiber reinforced materials.

20. The golf club head of claim 11, wherein the discretionary weight is made of a material selected from the group consisting of lead, tungsten, lead alloys, tungsten alloys, other metal materials that include lead, other metal materials that include tungsten, polymeric materials that include lead, and polymeric materials that include tungsten.

21. An iron-type golf club, comprising:

a shaft;

a grip attached to the shaft; and a golf club head configured to receive the shaft, wherein the golf club head further includes:

a striking face providing a front surface for engaging a golf ball and a rear surface opposite the front surface;

a perimeter weighting member extending rearward from the striking face and around at least a majority of a circumference of the striking face, wherein the perimeter weighting member at least partially defines a rear cavity in the golf club head;

a discretionary weight engaged with the perimeter weighting member; and a reinforcing structure at least partially located in the rear cavity, wherein the reinforcing structure includes a truss member, wherein the truss member extends from an upper portion of the perimeter weighting member to a lower portion of the perimeter weighting member, and further wherein the truss member includes a pair of beams connected by at least one cross-beam, wherein the pair of beams extend from the lower portion of the perimeter weighting member to the upper portion of the perimeter weighting member.

22. An iron-type golf club, comprising:

a shaft;

a grip attached to the shaft; and a golf club head configured to receive the shaft, wherein the golf club head further includes:

a striking face providing a front surface for engaging a golf ball and a rear surface opposite the front surface;

a perimeter weighting member extending rearward from the striking face and around at least a majority of a circumference of the striking face, wherein the perimeter weighting member at least partially defines a rear cavity in the golf club head a discretionary weight engaged with the perimeter weighting member; and a reinforcing structure at least partially located in the rear cavity, wherein the reinforcing structure includes a first truss member and a second truss member, wherein the first and second truss members extend from an upper portion of the perimeter weighting member to a lower portion of the perimeter weighting member, and further wherein the first truss member includes a first pair of beams connected by a first cross-beam, wherein the first pair of beams extend from the connection member to the upper portion of the perimeter weighting member and the second truss member includes a second pair of beams connected by a second cross-beam, wherein the second pair of beams extend from the lower portion of the perimeter weighting member to the upper portion of the perimeter weighting member.

* * * * *